US007065907B2

(12) United States Patent
Valiyambath Krishnan

(10) Patent No.: US 7,065,907 B2
(45) Date of Patent: Jun. 27, 2006

(54) ELECTRIC STEAMING DEVICE

(75) Inventor: Mohankumar Valiyambath Krishnan, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/525,169

(22) PCT Filed: Jul. 31, 2003

(86) PCT No.: PCT/IB03/03714

§ 371 (c)(1),
(2), (4) Date: Feb. 22, 2005

(87) PCT Pub. No.: WO2004/018936

PCT Pub. Date: Mar. 4, 2004

(65) Prior Publication Data

US 2006/0005437 A1 Jan. 12, 2006

(30) Foreign Application Priority Data

Aug. 26, 2002 (WO) ..... PCT/SG02/00202

(51) Int. Cl.
*D06F 75/18* (2006.01)
*D06F 75/22* (2006.01)

(52) U.S. Cl. ..... 38/77.83; 38/77.8

(58) Field of Classification Search ..... 38/77.8, 38/77.5, 77.9, 88, 93, 77.83, 96, 77.1; 392/403, 392/342, 399; 219/254
See application file for complete search history.

(56) References Cited

U.S. PATENT DOCUMENTS

| | | | | |
|---|---|---|---|---|
| 2,700,236 | A * | 1/1955 | Marvin et al. | 38/77.83 |
| 2,762,143 | A | 9/1956 | Hoecker | |
| 3,263,350 | A | 8/1966 | Abraham | |
| 4,616,122 | A * | 10/1986 | Burian et al. | 392/403 |
| 5,042,179 | A * | 8/1991 | van der Meer | 38/77.83 |
| 5,307,573 | A * | 5/1994 | Watkins | 38/77.8 |
| 5,345,703 | A * | 9/1994 | Farrington et al. | 38/77.5 |
| 5,787,614 | A * | 8/1998 | Stutzer | 38/77.1 |
| 6,035,563 | A * | 3/2000 | Hoefer et al. | 38/77.1 |
| 6,622,404 | B1 * | 9/2003 | Valiyambath | 38/96 |

FOREIGN PATENT DOCUMENTS

| | | |
|---|---|---|
| WO | WO00/66063 | 11/2000 |

* cited by examiner

*Primary Examiner*—Ismael Izaguirre
(74) *Attorney, Agent, or Firm*—Adam L. Stroud

(57) ABSTRACT

The invention relates to an electric steaming device, such as a steam iron or a facial sauna, having a steam generator (5) with a heatable base (12). According to the invention, water is sprayed onto the heatable base (12) via a nozzle (10) to generate steam (22). Some of the sprayed water (23) is mixed with the steam and taken along with the steam towards the steam outlet opening (16). The advantage is a high wet steam or vapor (24) production rate.

10 Claims, 2 Drawing Sheets

ELECTRIC STEAMING DEVICE

Figure 1:
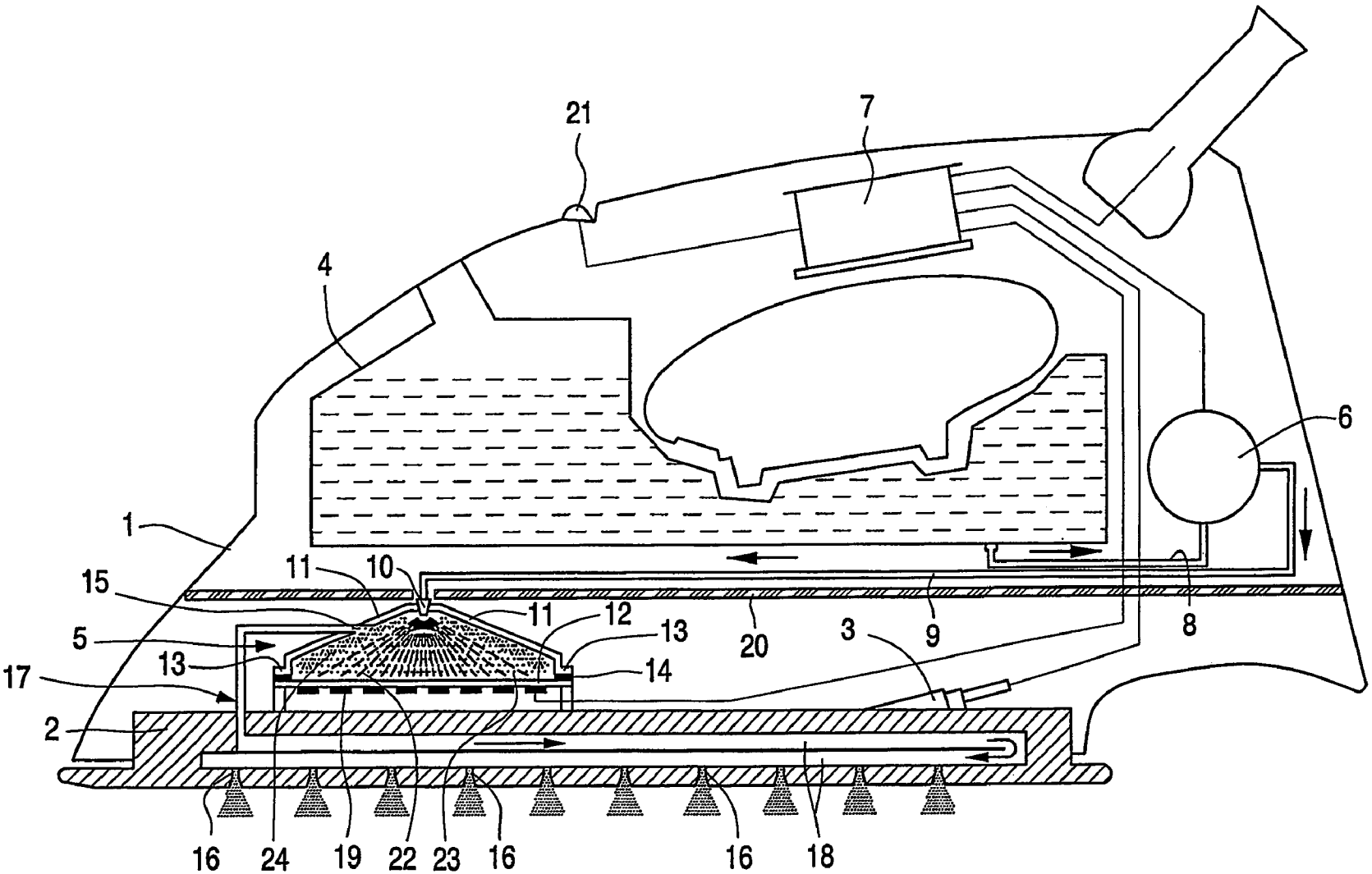

The invention relates to an electric steaming device comprising a housing, a steam generator having a base, heating means for heating said base of the steam generator, a water reservoir, at least one steam outlet opening, means for feeding water from the water reservoir into the steam generator, and at least one passageway for conveying steam from the steam generator towards the at least one steam outlet opening.

Such a steaming device is known, for example, from U.S. Pat. No. 3,263,350 which describes an electric steam iron. In this iron the means for feeding water from the water reservoir into the steam generator comprises a valve which permits controlled amounts of water in the form of droplets to enter the chamber of the steam generator by gravity flow. The actually delivered quantities of steam depend on the one hand on the amounts of water released by the valve and thus depend on the extent of the valve opening which can be controlled by the user, and on the other hand on the temperature of the base which is thermostatically controlled. Water released by the valve drips on the base in one location, and from this location it flows by gravity along the base for evaporation. Steam generated in this way is generally rather dry. For an easy removal of wrinkles, a garment should be moistened efficiently, which means that a good ironing result requires the steam discharged from the outlet openings of an iron to contain more water than obtained by the usual steam generation. From U.S. Pat. No. 2,762,143 it is known to insert water into the generated steam in order to obtain such a wet steam. The water is introduced into a steam passage outside the steam generator. It is desirable to generate wet steam or water vapor also for a device like a facial sauna as described in WO 00/66063.

It is an object of the invention to increase the steam production rate. It is another object of the invention to generate a wet steam.

According to the invention, these objects are achieved in that the means for feeding water into the steam generator comprises at least one spray nozzle for spraying water onto the base of the steam generator. The advantage of this arrangement is that water is sprayed over a relatively large surface area of the base with very fine water droplets, and thus steam is continuously generated over a large surface. The result is that the steam production is much higher per unit time than obtained by the known devices. Some of the sprayed water in the form of very fine droplets is mixed with and taken along with the generated steam. In this way a kind of wet steam, also referred to as mist, is obtained which is, for example, favorable for moistening garments in an ironing process or for obtaining vapor for a facial treatment or for steam cleaning. Contrary to known devices (U.S. Pat. No. 2,762,143), wet steam is already generated inside the steam generator. Another advantage is that steaming starts almost immediately after the spray of water has been introduced into the steam generator.

In a preferred embodiment of the steaming device, the heating means for heating the base of the steam generator comprises a resistive track of a thick-film printed circuit. A uniform heating of the base is obtained with a thick-film heating track applied to the base. The heated base reaches the desired temperature for steaming very rapidly. Moreover, the construction of the steam generator can be made lightweight.

In a further preferred embodiment, the means for feeding water into the steam generator comprises an electric pump.

Dosing of the amount of water to the nozzle and thus the amount of water spray can be easily adjusted by means of an electric pump. Also the location of the water reservoir relative to the steam generator can be freely chosen and is not dependent on gravity.

An example of the steaming device according to the invention is a steam iron having a soleplate, heating means for heating the soleplate, a plurality of steam outlet openings provided in the soleplate, wherein the passageway for conveying the generated steam to the steam outlet openings comprises at least one steam distribution channel provided in the heatable soleplate. Such a steam iron has a separate heating means, preferably also a resistive track of a thick-film printed circuit, while the temperature can be controlled independently of the heating means for heating the base of the steam generator.

Another example of the steaming device is a facial sauna.

These and other aspects of the invention will now be elucidated with reference to the embodiments described hereinafter.

Figure 2:
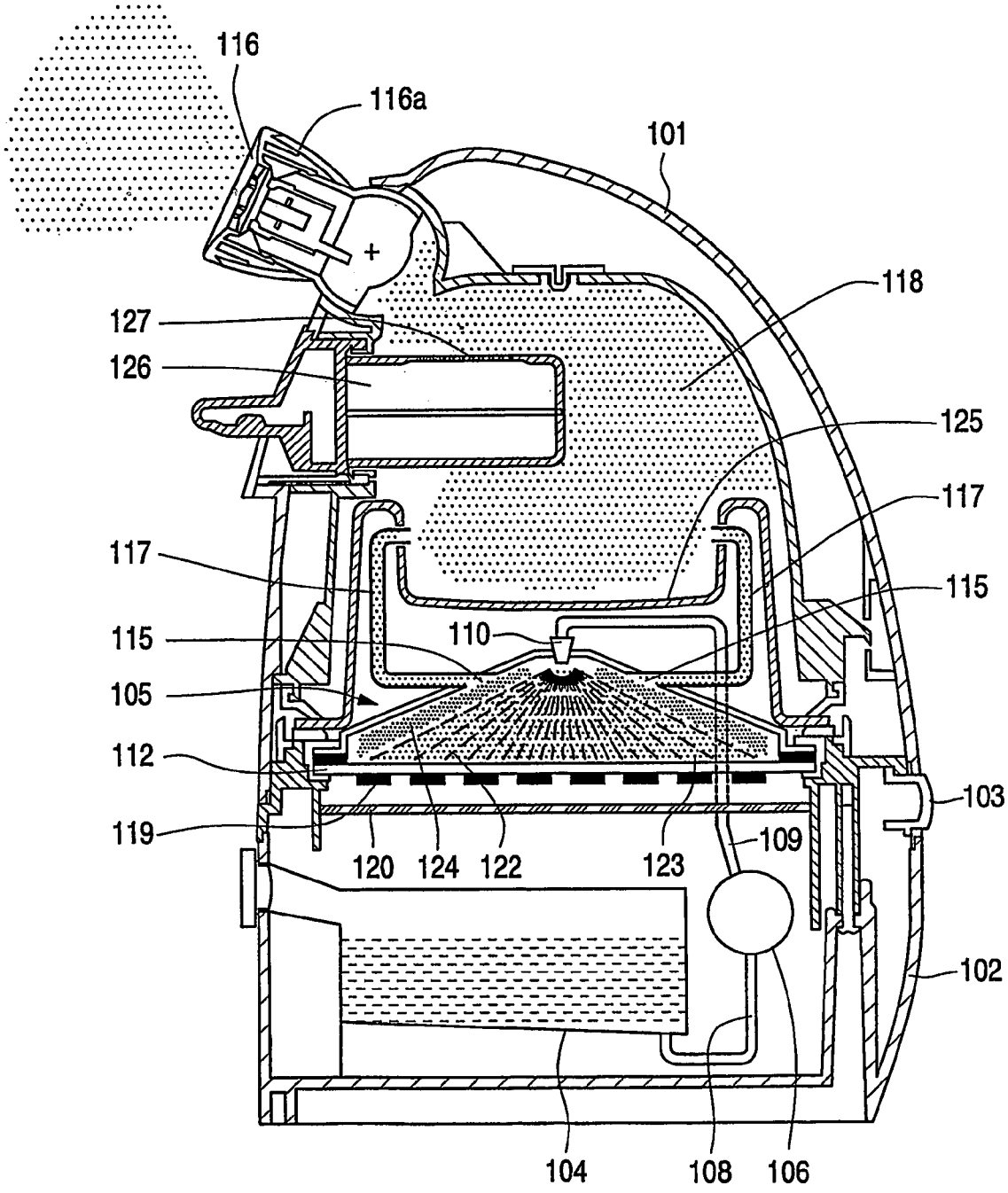

FIG. 1 is a diagrammatic cross-sectional view of an iron according to a first embodiment of the electric steaming device, and FIG. 2 is a diagrammatic cross-sectional view of a facial sauna according to a second embodiment of the electric steaming device.

The iron shown in FIG. 1 comprises a housing 1, a soleplate 2 attached to the lower side of the housing, an electric heating element 3 for heating the soleplate 2, a water reservoir 4, a steam generator 5, an electric pump 6, and a control device 7. A duct 8 connects the water reservoir 4 to the pump 6 and a duct 9 connects the pump 6 to the steam generator 5. A spray nozzle 10 is provided at the outlet of the duct 9. The steam generator 5 is roof-shaped with sloping sidewalls 11 and a base 12. Edges 13 of the sidewalls 11 are connected to the base 12. The sidewalls may be made of high temperature resistant plastics or composite material. The base may be made of aluminum.

The edges are thermally insulated from the base by means of a gasket 14. The spray nozzle 10 is provided in the apex of the roof-shaped steam generator 5. The steam generator 5 is provided with an outlet 15, which is arranged in a sidewall 11 at a distance above the base 12. The soleplate 2 is provided with a plurality of steam outlet openings 16. A passageway 17 connects the outlet 15 of the steam generator to the steam outlet openings in the soleplate. Part of this passageway is arranged in the soleplate so as to form a steam distribution channel 18. The lower side of the base 12 is provided with one or more resistive tracks 19 of a thick-film printed circuit. The track 19 is electrically insulated from the base 12. Heating of the tracks can be controlled by the control device 7. A heat shield 20 separates the water reservoir 4 and pump 6 from the steam generator 5 and the soleplate 2.

In operation, after powering the iron, the user can start the pump 6 by means of an operating knob 21. Water is pumped from the water reservoir 4 to the nozzle 10. A spray of water 22 is injected onto the heated base 12 of the steam generator 5 for a continuous and instantaneous generation of steam 23. Some of the sprayed water in the form of very fine droplets is mixed with and taken along with the generated steam towards the outlet 16. In this way wet steam 24 is obtained which flows through the passageway 17 and the distribution channel 18 to the steam outlet openings 16. The amount of sprayed water 22 can be controlled by means of the operating knob 21 (or another operating knob) and the control device 7, for example through pulse or duty cycle control of the pump 6. The outlet 15 of the steam generator 5 is arranged at a distance above the base 12 to avoid any dripping of water through the steam outlet openings 16. Tests have shown that, with a thick-film heating element of 1500 W and a surface area of the base 12 of about 42 $cm^2$, the steam production rate is 48 gram per minute, which is much higher than can be obtained by the existing household irons.

A second embodiment of an electric steaming device is shown in FIG. 2 and relates to a facial sauna. The facial sauna is constructed for generating and delivering water vapor for treatment of the facial skin. The facial sauna comprises an upper housing part 101 and a base part 102. The upper housing part 101 can be mounted on or removed from the base part 102. A button 103 can be operated for locking or unlocking these parts. A water reservoir 104 and a pump 106 are accommodated in the base part 102. A steam generator 105 is arranged in the housing 101, above the base part 102. A heat shield 120 separates the water reservoir 104 and the pump 106 from the steam generator. A duct 108 connects the water reservoir 104 to the pump 106 and a duct 109 connects the pump 106 to the steam generator 105. A spray nozzle ,110 is provided at the outlet of the duct 109. The steam generator 105 has a construction similar to that of the steam generator 5 described in the first embodiment shown in FIG. 1. A base 112 of the steam generator 105 is heated by means of a resistive track 119 of a thick-fin printed circuit. The steam generator is provided with two outlets 115. Passageways 117 connect the outlets 115 to a chamber 118. The housing 101 is provided with a vapor delivery nozzle 116a having a vapor (steam) outlet opening 116, which communicates with the chamber 118. A condensate receptacle 125 is provided inside the chamber 118. Reference numeral 126 indicates a removable additive cartridge for containing aromatic substances. Aromatic odor escapes through passages 127 in the upper wall of the cartridge and enters the chamber 118 to be mixed with the vapor.

The operation of the facial sauna is similar to that of the steam iron in the previous embodiment. A spray of water 122 is injected onto the heated base 112 of the steam generator 105 to generate steam 123 instantaneously. Some of the sprayed water is mixed with and taken along with the steam towards the outlets 115. The obtained wet steam or water vapor 124 enters the chamber 118 and flows to the outlet opening 116 of the vapor delivery nozzle 116*a*. The amount of vapor and how much water is mixed with the steam depends on the power of the heating track 119 and on amount of water sprayed 122 onto the base 112. It might happen that vapor condenses in the chamber 118. This condensate is collected in the receptacle 125. This receptacle can be emptied when the upper housing part 101 is removed.

The invention claimed is:

1. An electric steaming device comprising a housing, a steam generator (5;105) having a base (12;112), heating means (19;119) for heating said base of the steam generator, a water reservoir (4;104), at least one steam outlet opening (16;116), means (6,10;106,110) for feeding water from the water reservoir into the steam generator, and at least one passageway (17,117) for conveying steam from the steam generator (5;105) toward the at least one steam outlet opening (16;116), characterized in that the means for feeding water into the steam generator comprises a spray nozzle (10;110) for spraying water onto the base (12;112) of the steam generator (5;105), said means for spraying water being so adapted that a portion of the sprayed water is mixed with and taken along with conveyed generated steam as it exits the at least one steam outlet opening.

2. An electric steaming device as claimed in claim 1, characterized in that the heating means for heating the base (12;112) of the steam generator (5;105) comprises a resistive, track (19;119) of a thickfilm printed circuit.

3. An electric steaming device as claimed in claim 1, characterized in that the means for feeding water into the steam generator (5;105) comprises an electric pump (6;106).

4. An electric steaming device as claimed in claim 1, characterized in that the device is a steam iron with a soleplate (2), heating means (3) for heating the soleplate (2), and a plurality of steam outlet openings (16) provided in the soleplate (2), and in that the passageway (17) for conveying the generated steam to the steam outlet openings (16) comprises at least one steam distribution channel (18) provided in the heatable soleplate (2).

5. An electric steaming device as claimed in claim 1, characterized in that the device is a facial sauna.

6. An electric steaming device as claimed in claim 2, characterized in that the means for feeding water into the steam generator (5:105) comprises an electric pump (6:106).

7. An electric steaming device as claimed in claim 2, characterized in that the device is a steam iron with a soleplate (2), heating means (3) for heating the soleplate (2), and a plurality of steam outlet openings (16) provided in the soleplate (2), and in that the passageway (17) for conveying the generated steam to the steam outlet openings (16) comprises at least one steam distribution channel (18) provided in the heatable soleplate (2).

8. An electric steaming device as claimed in claim 3, wherein the device is a steam iron with a soleplate (2), heating means (3) for heating the soleplate (2), and a plurality of steam outlet openings (16) provided in the soleplate (2), and in that the passageway (17) for conveying the generated steam to the steam outlet openings (16) comprises at least one steam distribution channel (18) provided in the heatable soleplate (2).

9. An electric steaming device as claimed in claim 2, wherein the device is a facial sauna.

10. An electric steaming device as claimed in claim 3, wherein the device is a facial sauna.

* * * * *